US006840607B2

(12) United States Patent
Lee

(10) Patent No.: US 6,840,607 B2
(45) Date of Patent: Jan. 11, 2005

(54) CAP USED FOR REFILLING INK CARTRIDGE FOR PRINTER

(76) Inventor: So-Yeon Lee, 21-7, Chungdam-dong, Kangnam-gu, 135-102 Seoul (KR)

( * ) Notice: Subject to any disclaimer, the term of this patent is extended or adjusted under 35 U.S.C. 154(b) by 0 days.

(21) Appl. No.: 10/275,450

(22) PCT Filed: Feb. 19, 2002

(86) PCT No.: PCT/KR02/00251

§ 371 (c)(1),
(2), (4) Date: Nov. 4, 2002

(87) PCT Pub. No.: WO03/057491

PCT Pub. Date: Jul. 17, 2003

(65) Prior Publication Data

US 2003/0127417 A1 Jul. 10, 2003

(30) Foreign Application Priority Data

Jan. 9, 2002 (KR) ..... 20-2002-0000674

(51) Int. Cl.[7] ..... B41J 2/135
(52) U.S. Cl. ..... 347/86
(58) Field of Search ..... 347/85, 86, 29

(56) References Cited

U.S. PATENT DOCUMENTS 3,315,971 A * 4/1967 Sakurada ..... 277/615
4,172,803 A * 10/1979 Ichikawa et al. ..... 252/60
5,329,294 A 7/1994 Ontawar et al.
5,967,196 A 10/1999 Moser
6,158,848 A 12/2000 Liu
6,170,938 B1 1/2001 Kenyon
6,582,068 B2 * 6/2003 Ishizawa et al. ..... 347/85
6,676,252 B2 * 1/2004 Bilotta et al. ..... 347/86

* cited by examiner

*Primary Examiner*—K. Feggins
(74) *Attorney, Agent, or Firm*—Dorsey & Whitney LLP

(57) ABSTRACT

A cap used for refilling ink cartridge for printer includes a body which is forcibly inserted into an ink supply hole of the printer. A cylindrical ink receiving space is depressed into the body. A thin-film part, through which a nozzle of the printer pierces, is defined by the bottom surface of the ink receiving space. The diameter of the thin-film part is substantially the same as that of the nozzle of the printer. A plurality of leakage-preventing protrusions are integrally formed around the outer periphery of the body. Each protrusion includes an outward-slanted portion which is formed downward from the outer periphery of the body while being slanted outward, and a horizontal portion which is extended horizontally to the outer periphery of the body from the lower end of the outward-slanted portion.

4 Claims, 5 Drawing Sheets

CAP USED FOR REFILLING INK CARTRIDGE FOR PRINTER

TECHNICAL FIELD

The present invention relates to a cap used for refilling an ink cartridge of a printer, and more particularly, to a cap used for refilling an ink cartridge of a printer in which a plurality of leakage-preventing protrusions are formed on outer periphery of a body so that leakage of ink and influx of exterior air are reliably prevented when a cartridge is refilled.

BACKGROUND ART

As shown in FIGS. 6 and 6*a*, a cartridge of a general color ink-jet printer includes a plurality of ink reservoirs 11 divided by partitions, and includes a plurality of ink supply hole 12 connected to one side of each ink reservoir 11.

A hollowing ceiling member 13 is forcibly inserted in each ink supply hole 12. This ceiling member 13 prevents the ink from leaking between a side wall of the ink supply hole 12 and the ceiling member 13, and also guides ink to flow through a hollowing portion 13*a* thereof.

A thin-film 14 covering all ceiling member 13 and the hollowing portion 13*a* is attached on one surface of the cartridge 10, which prevents the ink from leaking through the hollowing member 13*a* of the ceiling member 13.

If a general ink cartridge 10 formed as described above is provided in a printer, a nozzle 21 provided on the printer pierces the thin-film 14 and is forcibly inserted into the hollowing portion 13*a*, thereby the ink in an ink reservoir 11 is supplied through the nozzle 21.

If at least one color of the ink is used up, a cartridge 10 is refilled through an injecting hole (not shown) formed on opposite surface of a general supply hole 12. At this time, a user blocks the hollowing portion 13*a* of the ceiling member 13 by attaching an attachable tape or sticker, etc., on the pierced thin-film 14 so as to prevent the refilling ink from leaking to outside.

However, this prior ink cartridge refilling method has a problem in that the pressure in the cartridge 10 in which the ink is refilled through the injecting hole is greater than the adhesive strength between the thin-film and the tape or sticker, thereby the ink leaks through a gap formed between the thin-film and the tape, which makes hands or clothes of the user to be stained with the ink.

Further, exterior air inflows into the cartridge 10 through a gap formed between the thin-film 14 and the tape, which leads to unstable state in the cartridge 10, thereby the quality of printing deteriorates.

DISCLOSURE OF INVENTION

The present invention is developed to solve the above-described problem. It is an object of the present invention to provide a cap used for refilling an ink cartridge of a printer in which leakage of ink and influx of exterior air are reliably prevented when an ink cartridge is refilled, thereby refilled cartridge can become stable quickly.

To achieve the above object, a cap, according to the present invention used to refill a cartridge of a printer provided with more than one ink reservoirs and more than one ink supply holes which are connected to the ink reservoir and a nozzle of a printer, which is inserted, includes a body forcibly inserted into the ink reservoir; an cylindrical ink receiving space formed in the body; a thin-film which is confined by bottom surface of the ink receiving surface and in which the nozzle of the printer passes through; and a plurality of leakage-preventing protrusions formed around outer periphery of the body.

Preferably, a diameter of the thin-film is the same as that of the nozzle, and the thickness of the thin-film is 0.1~1.0 mm.

The leakage-preventing protrusions include an outward-slanted portion which is formed downward from outer periphery of the body to outside, and a horizontal portion which extends horizontally from lower end of the outward-slanted portion to the outer periphery of the body.

BEST MODE FOR CARRYING OUT THE INVENTION

Hereinafter, a cap used for refilling an ink cartridge of a printer according to a preferred embodiment of the present invention will be explained in detail with reference to FIGS. 1 to 5.

Figure 1:
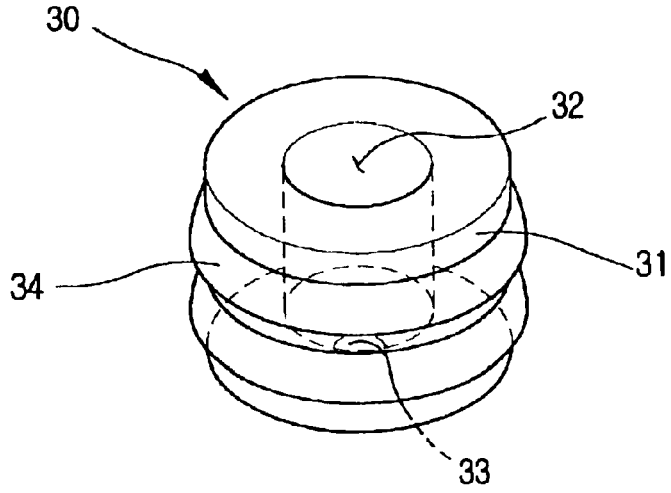
FIG. 1 is a perspective view showing a cap used for refilling an ink cartridge of a printer according to an embodiment of the present invention.
Figure 2:
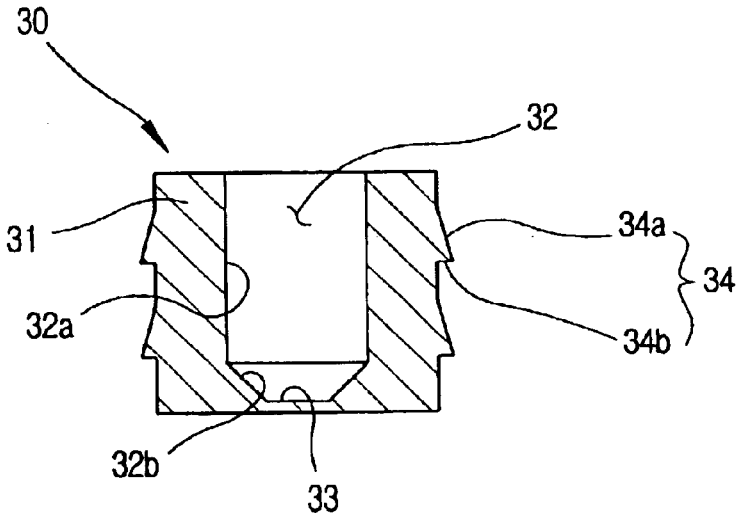
FIG. 2 is a cross-sectional view showing the cap in FIG. 1.

The cap 30 of the present invention is forcibly inserted into an ink supply hole 12 of an ink cartridge 10 when the ink is refilled in the ink cartridge 10. As shown in FIGS. 1 and 2, the cap 30 has a shape corresponding to that of the ink supply hole 12, for example like a cylindrical body 31, and an ink receiving space 32 is formed into the body 31.

Side wall of the ink receiving space 32 includes a vertical portion 32*a* which vertically extends from upper end of the body 31 toward the lower end, and an inward-slanted portion 32*b* which inwardly slants from the lower end of the vertical portion 32*a* to the center of the body 31.

The inner bottom of the ink receiving space 32 is formed with the thin-film 33 confined by the lower end of the inner-slanted portion 32*b*.

Furthermore, a plurality of leakage-preventing protrusions 34, which radially protrude, are integrally formed on the outer periphery of the body 31 of the cap 30. The leakage-preventing protrusions 34 prevent the ink leaks between the cap 30 and the ink supply hole 12 of the cartridge 10.

The leakage-preventing protrusions 34 include the outward-slanted portion 34*a* which downwardly extends from the outer periphery surface of the body 31 to outside, and the horizontal portion 34*b* which horizontally extends from the upper end of the outward-slanted portion 34*a* to the outer periphery surface of the body 31. That is, the outer periphery surface of the body 31 and the horizontal portion 34*b* are formed perpendicularly to each other.

Figure 3:
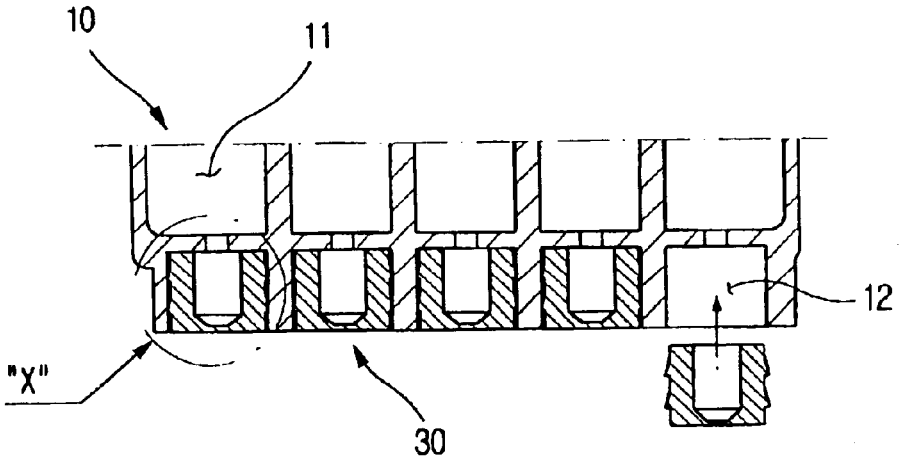
FIG. 3 is a cross-sectional view showing a state in which the cap in FIG. 1 is installed in a printer.
Figure 3A:
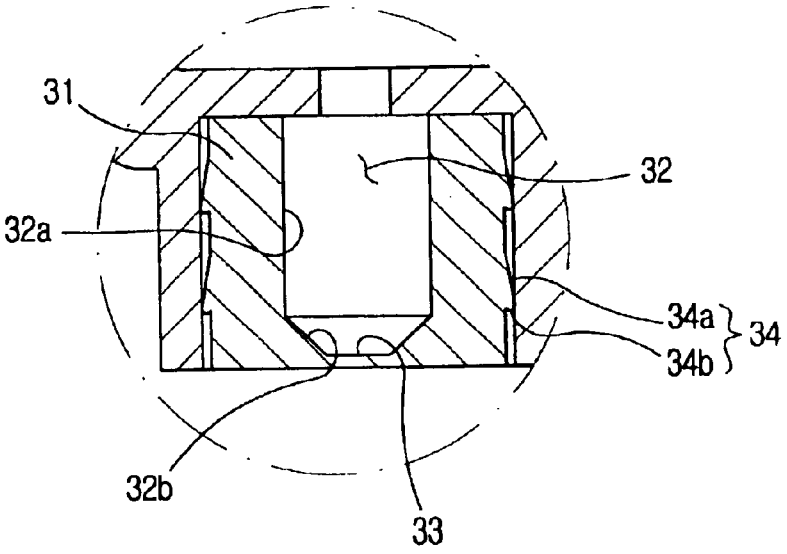
FIG. 3*a* is an enlarged view of X-portion in FIG. 3.

The another object of forming the outward-slanted portion 34*a* of the leakage-preventing protrusions 34, other than to prevent the leakage of the ink, as shown in FIG. 3, is to easily insert the cap 30 with force into the ink supply hole 12 of the cartridge 10. Also, the horizontal portion 34*b* is formed perpendicularly to the outer surface of the body 31 to prevent that the cap 30, which is closely contacted to the outer periphery surface of the nozzle 21 of the printer, from coming out together with the nozzle 21, so the cap 30 is easily separated from the ink supply hole 12 when the cartridge 10 is separated from the printer.

Figure 4:
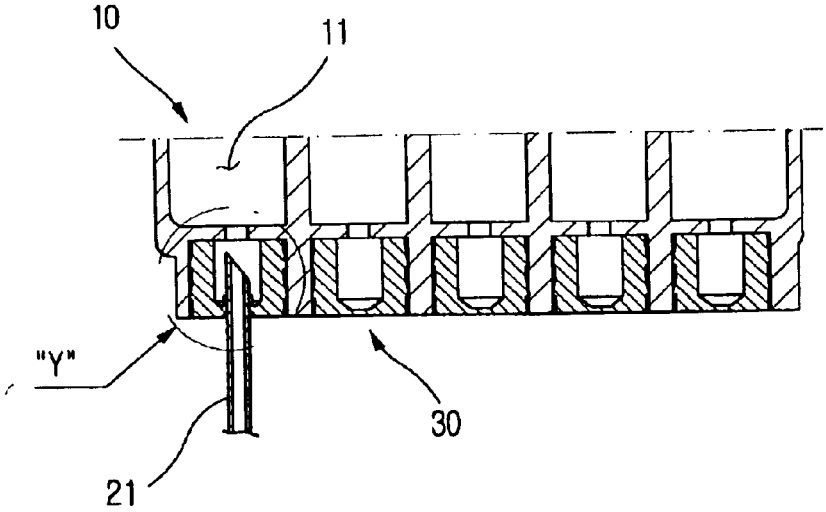
FIG. 4 is a cross-sectional view showing a state in which the cartridge in FIG. 3 is installed in a printer.
Figure 4A:
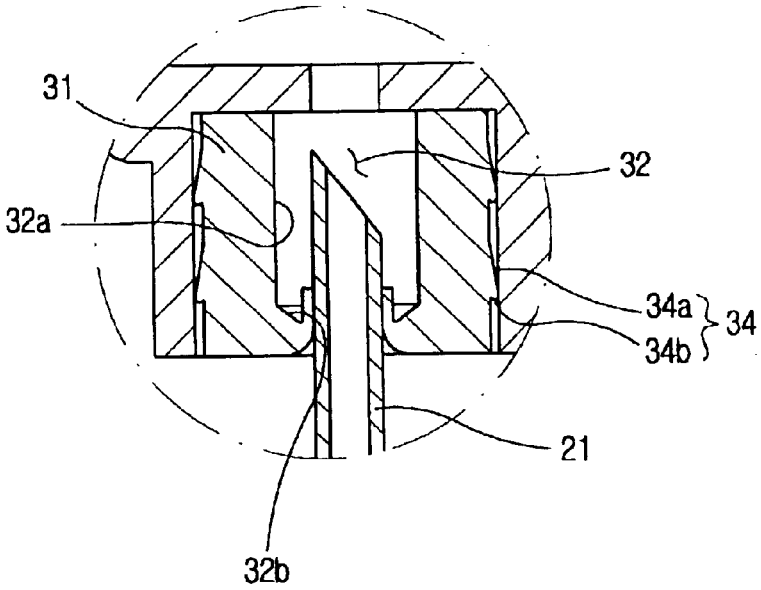
FIG. 4*a* is an enlarged view of Y-portion in FIG. 4.

If the cartridge 10, in which the cap 30 formed as described above is forcibly inserted, is installed in the printer, as shown in FIGS. 4 and 4*a*, the nozzle 21 of the printer pierces the thin-film part 33 of the cap 30 then presents in the ink receiving space 32, whereby the ink in the ink reservoir 11 of the cartridge 10 may be transferred to the printer. At this time, lower end surface of the inward-slanted portion 32*b* of the ink receiving space 32 is closely contacted to the outer periphery surface of the nozzle 21, which prevents the ink from leaking. For this, it is preferable that a diameter of the film-thin part 22 and that of the nozzle 21 of the printer are formed to have substantially the same size. Also, the thin-film part 33 is formed to have the thickness of 0.1~1.0 mm so that it is easily pierced by the nozzle 21. Further, the material of the thin-film part 33 is rubber or synthetic, etc., having elasticity.

Figure 5:
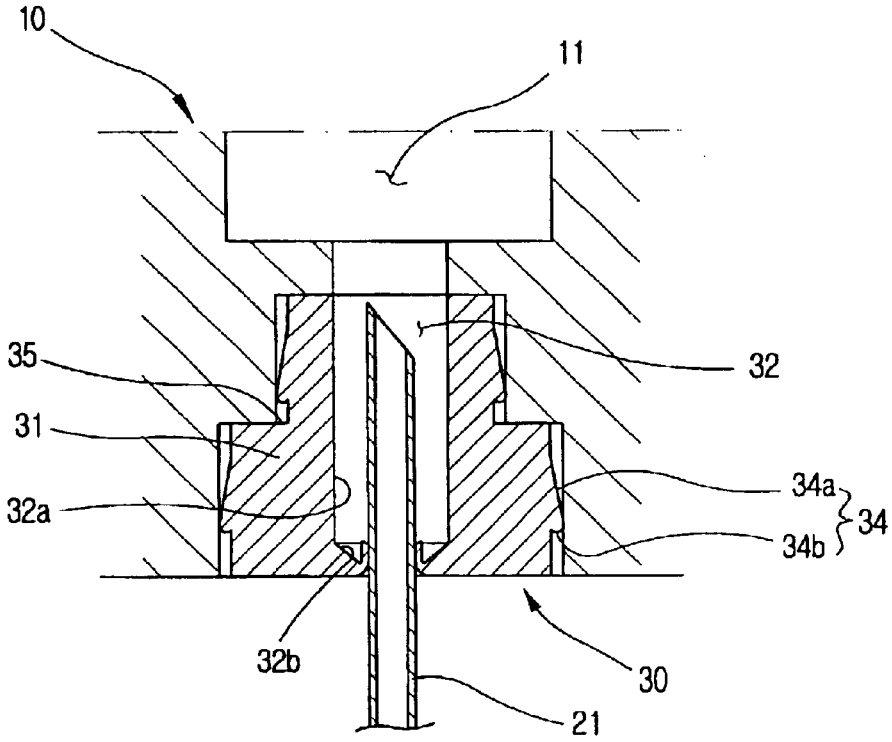
FIG. 5 is a cross-sectional view showing a state in which a cap according to another embodiment of the present invention is used.
Figure 6:
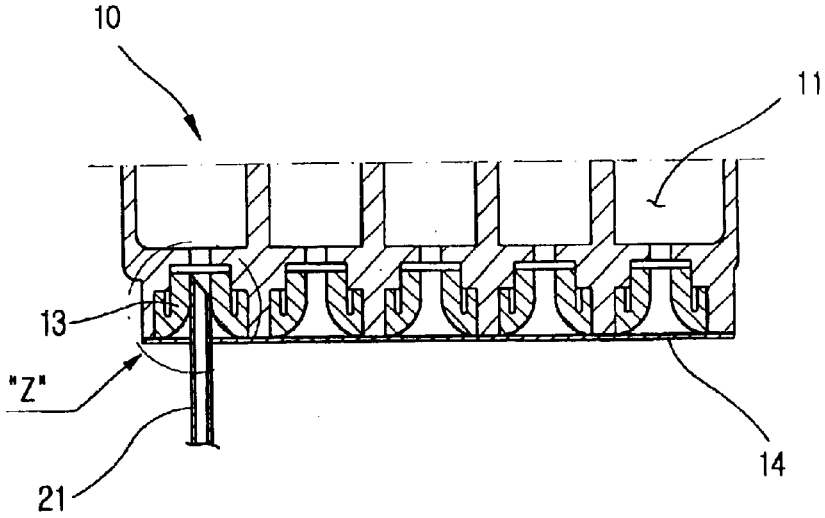
FIG. 6 (PRIOR ART)
FIG. 6 is a partial cross-sectional view showing a structure of a general cartridge of a printer.
Figure 6A:
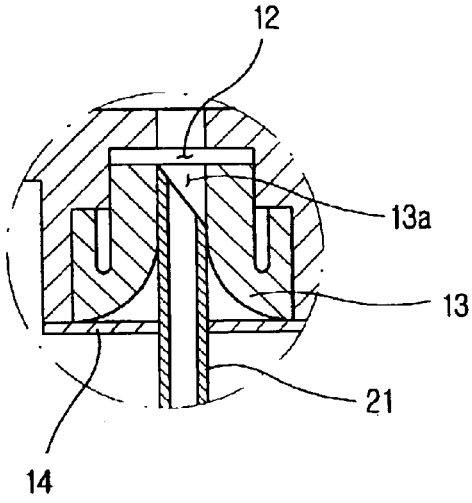
FIG. 6A (PRIOR ART)
FIG. 6*a* is an enlarged view of Z-portion in FIG. 6.

Meanwhile, the cap 30 of the present invention is not restricted to the structure shown in FIG. 1, but as shown in FIG. 5, may be changed variously following the shape of the ink supply hole 12 of the cartridge 10, for example, like a shape of the stepping portion 35.

Hereinafter, an operation of the cap used for refilling an ink cartridge of a printer according to the present invention having above-described structure will be explained with reference to accompanying drawings.

When more than one color of the ink in the cartridge 10 of the printer is used up, generally, new ink is refilled in the cartridge 10 through the injecting hole (not shown) formed on opposite surface of the ink supply hole 12. At this time, to prevent the refilling ink from flowing through the pierced thin-film 14, the thin-film 14 and the ceiling member 13 are perfectly removed from the ink supply hole 12, then as shown in FIG. 3, the cap 30 of the present invention is forcibly inserted into the ink supply hole 12 so that the ink reservoir 11 and the ink receiving space 32 of the cap 30 are connected. At this time, the cap 30 is easily and forcibly inserted into the ink supply hole 12 by the leakage-preventing protrusions 34 having the outward-slanted portion 34*a* formed toward a direction where the cap 30 is forcibly inserted into the supply hole 12.

As like this, in a state where the cap 30 is forcibly inserted into the ink supply hole 12, ink is injected in the cartridge 10 through the injecting hole. At this time, not only the ink leaks through a gap formed between the cap 30 and the ink supply hole 12 but also exterior air inflow into the cartridge 10 through the gap by the leakage-preventing protrusions 34 closely contacted to the inner periphery surface of the ink supply hole 12 are prevented.

In this state, when the cartridge 10 is installed in the printer, as shown in FIG. 4, the nozzle 21 of the printer pierces into the thin-film part 33 of the cap 30 then is inserted into the ink receiving space 32, thereby the ink in the ink reservoir 11 of the cartridge 10 is supplied to the printer through the nozzle 21.

At this time, the outer periphery surface of the nozzle 21 installed in the thin-film part 33 is closely contacted to the inward-slanted portion 32*b* of the ink receiving space 32, thereby the leakage of the ink is prevented.

Meanwhile, if the cartridge should be refilled due to the depletion of at least one color ink, the cartridge 10 is separated from the printer. At this time, the cap 30 closely contacted to the outer periphery surface of the nozzle 21 is prevented from separating from the ink supply hole 12 by the nozzle 21, and by the leakage-preventing protrusions 34 having the horizontal portion 34*b* perpendicularly formed on the outer periphery surface of the nozzle 21.

Afterward, the cap 30, in which the thin-film part 33 is pierced, is removed from the ink supply hole 12, and new cap 30 is forcibly inserted into the ink supply hole 12 again. Thereby, refilling of the cartridge 10 is achieved as described above.

As explained in detail in the above, the cap according to the present invention is replaced and forcibly inserted into the ink supply hole, which leads to easy refillment of the cartridge for limited times.

Further, when ink cartridge is refilled, the leakage of the ink and the influx of exterior air can be reliably prevented by the leakage-preventing protrusions formed on a cap. Thereby, the refilled cartridge becomes stable quickly, so the quality of printing can be improved.

While the present invention has been particularly shown and described with reference to particular embodiments thereof, it will be understood by those skilled in the art that various changes in form and details may be affected therein without departing from the spirit and scope of the invention as defined by the appended claims.

What is claimed is:

1. A cap used for refilling an ink cartridge for printer having more than one ink reservoir, and more than one ink supply hole which is connected to said ink reservoir and in which a nozzle of the printer is inserted, said cap comprising:

a body forcibly inserted into said ink supply hole;

a cylindrical ink receiving space formed in said body;

a thin-film part confined by a bottom surface of said ink receiving space and which said nozzle of said printer passes through;

a plurality of leakage-preventing protrusions formed on an outer periphery surface of said body, wherein a diameter of said thin-film part is the same as that of said nozzle.

2. A cap used for refilling an ink cartridge for a printer as claimed in claim 1, wherein a thickness of said thin-film part is 0.1~1.0 mm.

3. A cap used for refilling an ink cartridge for printer having more than one ink reservoir, and more than one ink supply hole which is connected to said ink reservoir and in which a nozzle of the printer is inserted, said cap comprising:

a body forcibly inserted into said ink supply hole;

a cylindrical ink receiving space formed in said body;

a thin-film part confined by a bottom surface of said ink receiving space and which said nozzle of said printer passes through;

a plurality of leakage-preventing protrusions formed on an outer periphery surface of said body, wherein said leakage-preventing protrusions include an outward-slanted portion formed downward from an outer periphery of said body to outside, and a horizontal portion horizontally extending from a lower end of said outward-slanted portion to said outer periphery surface of said body.

4. A cap used for refilling an ink cartridge for a printer as claimed in claim 3, wherein a thickness of said thin-film part is 0.1~1.0 mm.

* * * * *